United States Patent [19]

Kallenborn

[11] 4,065,065

[45] Dec. 27, 1977

[54] METHOD AND APPARATUS FOR COLLECTING STRAND MATERIAL

[75] Inventor: John Kallenborn, Murrysville, Pa.

[73] Assignee: PPG Industries, Inc., Pittsburgh, Pa.

[21] Appl. No.: 757,722

[22] Filed: Jan. 7, 1977

Related U.S. Application Data

[63] Continuation of Ser. No. 677,359, April 15, 1976, abandoned.

[51] Int. Cl.[2] ..... B65H 54/10

[52] U.S. Cl. ..... 242/18 G; 65/11 W

[58] Field of Search ..... 242/18 G, 18 R, 43; 65/11 W, 11 R

[56] References Cited

U.S. PATENT DOCUMENTS

| | | | |
|---|---|---|---|
| 2,613,039 | 10/1952 | Holcomb | 242/18 G |
| 3,041,664 | 7/1962 | Green | 242/43 X |
| 3,051,402 | 8/1962 | Rees | 242/18 G |
| 3,115,312 | 12/1963 | Rees | 242/18 G |
| 3,695,523 | 10/1972 | Genson | 242/43 |

*Primary Examiner*—Edward J. McCarthy

*Attorney, Agent, or Firm*—Alan T. McDonald; John E. Curley

[57] ABSTRACT

A method and apparatus are disclosed for collecting strand material, and especially glass strands. The method comprises oscillating the mid point of a rotating surface on which the strand material is collected through an included angle from the horizontal and oscillating the rotating surface in the vertical direction to thereby maintain a constant distance between the source of the strand material and the face of the forming package of strand material on the rotating surface. Suitable apparatus for achieving this result is also disclosed.

20 Claims, 3 Drawing Figures

METHOD AND APPARATUS FOR COLLECTING STRAND MATERIAL

CROSS-REFERENCE TO RELATED APPLICATIONS

This application is a continuation-in-part application of U.S. Ser. No. 677,359, filed Apr. 15, 1976, entitled METHOD AND APPARATUS FOR COLLECTING STRAND MATERIAL, abandoned.

BACKGROUND OF THE INVENTION

Strand material, such as glass, nylon, orlon, cotton, and other like strands, is typically collected by winding the strand material around a rotating surface such as a collet. In the case of glass strands, glass filaments are typically attenuated through orifices or bushing tips at the bottom of a heated bushing containing molten glass. The filaments are then passed across the application surface of an applicator where they are coated with a binder and/or size. The filaments are subsequently gathered into a unified strand by a gathering shoe, which is typically a grooved cylinder formed of material such as graphite. Alternatively, the applying and gathering steps may be accomplished by a single device, such as a pad applicator. The strand is then traversed across the face of a rotating spiral and wound on a rotating mandrel or collet as a forming package.

Several problems are encountered in the collection of glass strands in this manner. The rotating spiral wears due to the abrasion between its surfaces and the glass strands passing across it, necessitating frequent replacement of the spirals. Further, since this wear is not always uniform across the surfaces of the spiral, ridges and/or nicks in the surface of the spiral can often result. These ridges or nicks are locations where the glass strand may break out, thus necessitating a stoppage in what is desired to be a continuous process. Any nick or ridge on a spiral results in an even shorter life of the spiral than would normally be expected by uniform wear on its surface.

It would, therefore, be desirable to wind strand material, and especially glass strands, without the necessity of traversing the strands across the face of a rotating spiral prior to winding them on the rotating collet.

A second problem with winding glass strands is in the construction of the collet. In many applications, the collet, which is the rotating surface on which strands are collected, reciprocates along its axis under the rotating spiral to allow the strands to build up as a forming package across essentially the entire length of the collet. The weight of the collet itself along with that of the strands being wound thereon, which may themselves weigh up to about 125 pounds (56.63 kilograms) and more, places a great deal of strain on the bearings which hold the collet, especially as the collet is reciprocated to its outermost position away from the bearings, due to bending moment forces acting on the bearings. These bearings have often failed in the past due to the forces being exerted upon them. This requires shut down for bearing replacement in the collet and considerable lost time and maintenance expense.

It would also, therefore, be desirable to eliminate the necessity for reciprocating the collet below a rotating spiral.

In U.S. Pat. No. 3,115,312 a glass strand collecting apparatus is disclosed which has eliminated both the rotating spiral and the necessity of reciprocating the collet under a spiral or other traversing means. In this patent, the rotating collet is connected to a motor which supplies the rotational forces for it. The motor is mounted on a rotating cam to raise and lower both the motor and the collet through an included angle. As the collet rises and falls the strand is collected at various locations along its face to enable a generally cylindrical package to be formed along essentially the entire length of the collet.

A problem of the strand collection system of this patent lies in its geometry. As the collet rises and falls, the distance between the collet surface and the supply of strand, in this case the applicator pad surface, is variable, being shortened as the collet rises and being lengthened as the collet falls. This produces an uneven tension on the strand as it is being wound.

Uneven tension results in two deleterious effects to the strand. If severe enough, the tension variations will cause the strand to break, thus requiring restarts of the system and reduction in its overall productivity. Less noticeable, but as severe, is the problem of nonuniform strand quality due to uneven tension on the strand. The rotating collet winding the strand thereon produces the attenuative forces for drawing the filaments which form the strand from the bushing tips in the bushing. The amount of pull on the filaments is directly proportional to the tension exerted on the strand. Also, for a given bushing tip or orifice size, the diameter of the filaments being formed is dependent upon the pull given to the filaments and thus upon the tension on the strand. If the strand tension changes, as is continuously the result in this patent, the filament diameter will also continuously change, thus resulting in a low quality strand which is commercially unacceptable.

It is therefore desirable to collect strand material, and especially glass strands, with a constant level of tension being exerted on the strand.

THE PRESENT INVENTION

By means of the present invention, a method and apparatus for collecting glass strands which eliminates or reduces considerably the problems associated with the prior art systems is provided. The method of the present invention involves oscillating the mid point of a rotating collection surface for strand material through an included angle from the horizontal to collect the strands at desired positions along rotating surface. As the collet is oscillated through this included angle, the entire collet is also oscillated in the vertical direction. This combination of movements maintains a constant distance between the collet and the source of the strand, thus maintaining a constant tension on the strand and a constant diameter to the filaments to thereby produce a high quality strand. As part of maintaining this distance constant, the uppermost vertical oscillation of the collet toward the source of the strand is reduced in an amoung equal to the package build of strand on the collet, such that a constant distance is maintained between the source of the strand and the face of the ever-expanding forming package.

The preferred apparatus for accomplishing this result involves a rotating collet, a means for oscillating the mid point of the collet through an included angle from the horizontal, means for oscillating the collet in the vertical direction is response to the oscillation of the mid point of the rotating surface to amintain a constant distance between the source of the strand and the face of the forming package and means for timing the oscillatory movements to accomplished this result.

In an alternative embodiment, the strand may be passed through a strand guide to help maintain the strand in alignment.

In a further embodiment, a rotating spiral may be located above the collet to further traverse the strand across the collet face.

DETAILED DESCRIPTION OF THE DRAWINGS

Figure 1:
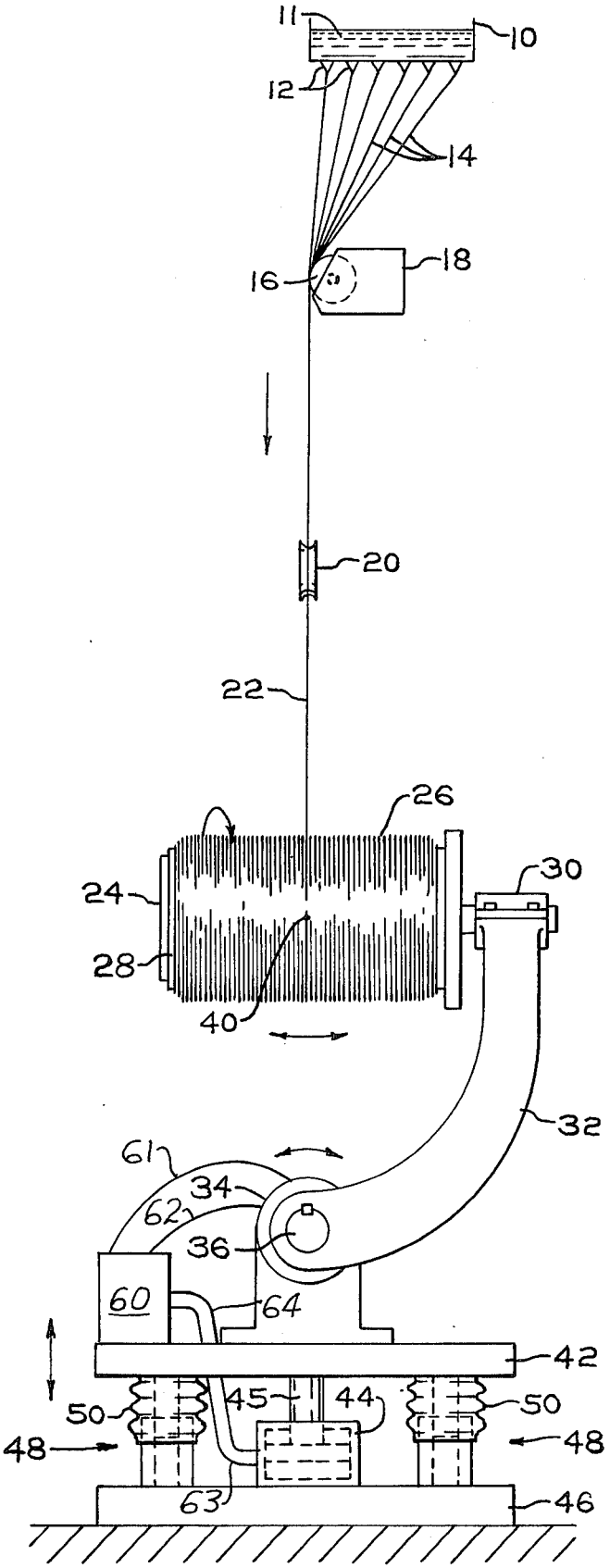
FIG. 1 is a side elevation of a glass fiber forming operation illustrating the preferred strand collecting method and apparatus of the present invention.

Turning now to FIG. 1, glass filaments 14 are attenuated through bushing tips 12 in a heated bushing 10 containing molten glass 11. The filaments 14 are drawn across the application surface 16 of an applicator 18 where they are coated with a binder and/or size. The applicator 18 may be, for example, a belt applicator, a roller applicator or the like. Filaments 14 are then gathered into a unified strand 22 by a gathering shoe 20. This gathering shoe 20 is typically a grooved cylinder or wheel made of material such as graphite, with the filaments 14 being gathered into strand 22 in the groove.

Strand 22 is collected on the rotating surface of a collet 24 as a forming package 26. Preferably, the forming package 26 is collected on a forming tube 28, however it is within the scope of the present invention to collect the forming package 26 directly on the surface of the rotating collet 24. The collet 24 is a self-contained motorized collet, i.e., the motor is internal to the collet 24 and rotates around the shaft therein. Such a collet is more fully described in U.S. Pat. No. 3,871,592 which is incorporated herein by reference. The collet 24 is connected by means such as a bracket 30 to arm 32. This arm 32 is connected to a reversing motor 34. The motor 34 reciprocates its shaft 36 to which the arm 32 is connected through an included angle. This reciprocates the arm 32 and oscillates the mid point 40 on the collet 24 through the same included angle as the shaft 36. This oscillation of the mid point is measured as a change in angle of a line parallel to the collet and passing through the mid point 40 from the horizontal. The motor 34 is any motor which is capable of reciprocating through an included angle and is preferably a hydraulic vane motor. The included angle from the horizontal through which the collet oscillates can range up to about 120°, i.e., about 60° in each direction from the horizontal.

In response to and timed with the oscillation of the collet 24, the base 42 on which the reciprocating motor, arm, and collet are carried is oscillated in the vertical direction by means such as a hydraulic cylinder 44 having a piston 45. The vertical oscillations of the collet 24 is timed to compensate for any changes in distance between the gathering shoe 20 and the surface of the forming package 26 as the collet 24 oscillates through the included angle to maintain this distance constant and thus maintain the tension on the strand constant. Further, the action of the hydraulic cylinder is programmed and timed such that as the forming package 26 builds in diameter, the uppermost vertical oscillation of the collet 24 is reduced in an amount equal to the package build on the collet 24 to complete the maintenance of the distance between the gathering shoe and the ever-expanding forming package 26 constant. Post guides 48 and bellows 50 surrounding them are provided to connect the base 42 on which the reciprocating motor 34 is located and the base 46 on which the hydraulic cylinder 44 is located.

Suitable timing means 60 is connected to the reciprocating motor 34 through electrical lines 61 and 62 and to the hydraulic cylinder 44 through electrical lines 63 and 64 to link the actions of the reciprocating motor 34 and the hydraulic cylinder 44, or whatever other reciprocating means and vertical oscillating means are employed, to coordinate the actions of these elements such that the length of strand between the mid point 40 of the collet 24 and the source of strand, such as the gathering shoe 20, remains constant.

Then preferred timing means is a digital programmable timer which can be preset through digital thumbwheels and the like to corrolate the vertical movement with the angular change of the collet and the package build. The programming of this timer is individually set to suit the size and shape of a given package wind. The angular change of the mid point of the collet is a linear function. The package build on the collet is a hyperbolic function. Thus, the digital programmer automatically combines these two functions, for a given package, and determines the actions of both the motor 34 and the hydraulic cylinder 44 to give the desired package builds and maintain the distance between the face of the package and the strand source constant. A typical digital programmable timer for achieving this result is a Research, Inc. Industrial Model 812 Direct Digital Process Control System. The use of programmers to control collet operation is illustrated in U.S. Pat. No. 3,109,602 and U.S. Pat. No. 3,367,587.

Thus, as the strand 22 is wound around the rotating collet 24, the collet 24 has its mid point oscillated through an included angle from the horizontal by the action of the reciprocating motor 34 and arm 32, and the entire assembly is oscillated in the vertical direction by the action of the hydraulic cylinder 44 to maintain a constant distance between the face of the forming package 26 and the gathering shoe 20, thus maintaining a constant level of tension on the strand 22.

Figure 2:
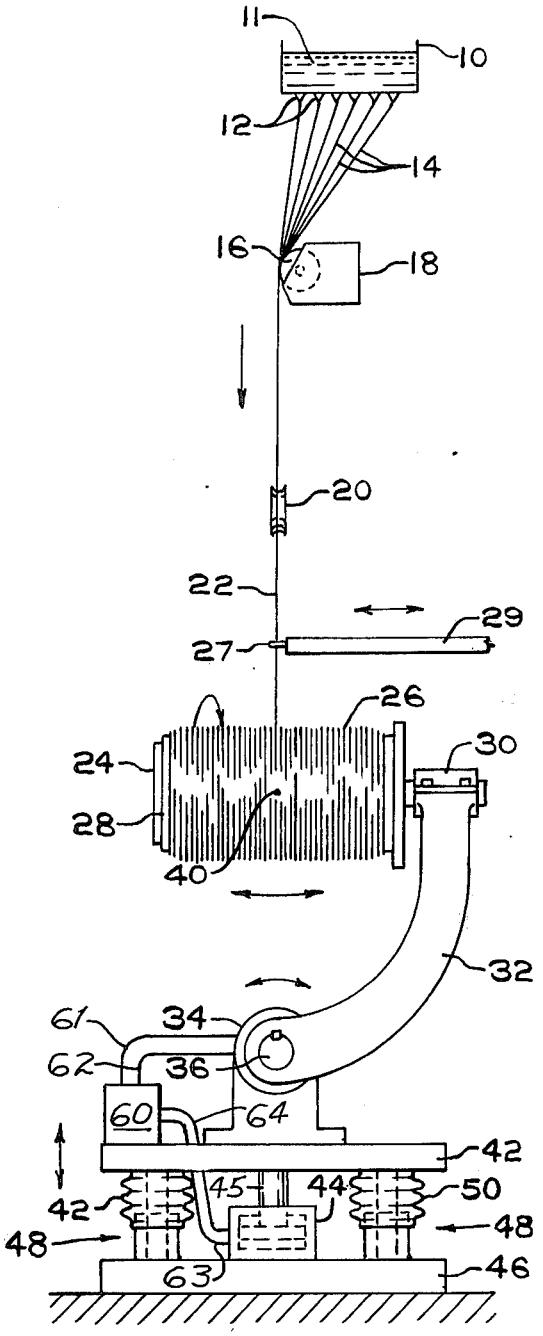
FIG. 2 is an alternative embodiment illustrating the location of the strand guide, when employed.
Figure 3:
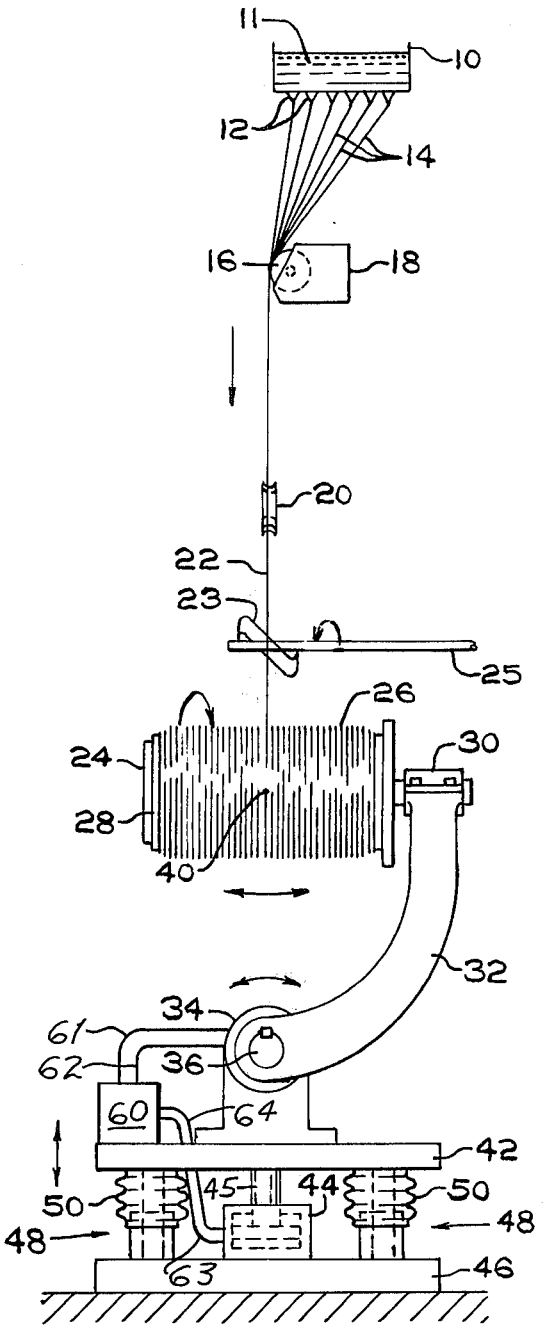
FIG. 3 is an alternative embodiment illustrating the location of the spiral, when employed.

Optionally, as shown in FIG. 2, a reciprocating strand guide eye 27 may be provided between the gathering shoe 20 and the collet 24 which would not be attached to the arm 32 but, for example, to a reciprocating means behind the backwall of the forming level such as a rod 29 connected to a motor driven traversing cam, not shown, to help maintain the direction of travel of the strand 22 from the gathering shoe 20 to the collet 24.

Less preferably, but still within the purvue of the present invention, a rotating spiral assembly 23 may be attached behind the backwall or other location on the forming level by means such as a rod 25 connected to a motor, not shown, to aid in traversing the strand across the face of the collet 24. This is not, however, preferred and is to be used, for example, when the ultimate use of the forming package 26 demands such a strand pattern on the forming package 26.

As can be seen from the foregoing, the present invention provides an effective method and apparatus for forming and collecting strand material, and especially glass strands.

While the present invention has been described with reference to specific embodiments thereof, it is not intended to be so limited thereby, except as set forth in the accompanying claims.

I claim:

1. In a method of forming glass strand comprising attenuating filaments from molten glass through bushing tips in a bushing, gathering the filaments into strand in a gathering means and collecting the strand on a rotating surface, the improvement comprising oscillating the mid point of the rotating surface through an included angle from the horizontal, oscillating the rotating surface in the vertical direction and timing said vertical oscillations in response to said oscillations of the mid point of the rotating surface through the included angle from the horizontal to maintain a constant length of strand between the gathering means and the rotating surface.

2. The method of claim 1 wherein said included angle is up to about 120°.

3. The method of claim 1 further comprising traversing the strand across the face of a rotating spiral prior to collecting the strand on the rotating surface.

4. A method of collecting strand from a source on a rotating surface comprising oscillating the mid point of the rotating surface through an included angle from the horizontal, oscillating the rotating surface in the vertical direction and timing said vertical oscillations in response to said oscillations of the mid point of the rotating surface through the included angle from the horizontal to maintain a constant length of strand between the source and the rotating surface.

5. The method of claim 4 wherein said included angle is up to about 120°.

6. The method of claim 4 further comprising traversing the strand across the face of a rotating spiral prior to collecting the strand.

7. Apparatus for collecting strand from a source comprising a rotating surface, means for oscillating the midpoint of the rotating surface through an included angle from the horizontal, means for oscillating the rotating surface in the vertical direction and a control means, said control means being connected to the means for oscillating the midpoint of the rotating surface to regulate the oscillations thereof and being connected to the means for oscillating the rotating surface in the vertical direction to regulate the oscillations thereof, to thereby maintain a constant length of strand between the source and the rotating surface.

8. The apparatus of claim 7 wherein said means for osciallating the mid point through the included angle comprises an arm having connected to it said rotating surface at one end and a reversing motor connected to said arm at its other end.

9. The apparatus of claim 8 wherein said motor is a hydraulic vane motor.

10. The apparatus of claim 7 wherein said means for oscillating the rotating surface in the vertical direction comprises a hydraulic cylinder.

11. The apparatus of claim 7 wherein said control means is a digital programmable timer.

12. The apparatus of claim 7 further comprising a spiral and means for rotating the spiral, said spiral being located between the strand source and the rotating surface.

13. The apparatus of claim 7 further comprising a strand guide, said strand guide being located between the strand source and the rotating surface.

14. Apparatus for forming glass strand comprising a bushing having a plurality of bushing tips through which glass filaments may be drawn, an applicator for applying binder and/or size to the filaments, a gathering shoe for gathering the filaments into strand, a rotating surface for collecting the strand, means for oscillating the midpoint of the rotating surface through an included angle from the horizontal, means for oscillating the rotating surface in the vertical direction and a control means, said control means being connected to the means for oscillating the midpoint of the rotating surface to regulate the oscillations thereof and being connected to the means for oscillating the rotating surface in the vertical direction to regulate the oscillations thereof, to thereby maintain a constant length of strand between the gathering shoe and the rotating surface.

15. The apparatus of claim 14 wherein said means for oscillating the mid point comprises an arm connected at one end to the rotating surface and a reversing motor connected to said arm at its other end.

16. The apparatus of claim 15 wherein said reversing motor is a hydraulic vane motor.

17. The apparatus of claim 14 further comprising a spiral and means for rotating the spiral, said spiral being located between the gathering shoe and the rotating surface.

18. The apparatus of claim 14 further comprising a strand guide, said strand guide being located between the gathering shoe and the rotating surface.

19. The apparatus of claim 14 wherein said control means comprises a digital programmable timer.

20. The apparatus of claim 14 wherein said means for oscillating the rotating surface in the vertical direction comprises a hydraulic cylinder.

* * * * *